US005846339A

United States Patent [19]

Masshoff et al.

[11] Patent Number: 5,846,339

[45] Date of Patent: Dec. 8, 1998

[54] MACHINE DISHWASHING PROCESS

[75] Inventors: Hans Wilhelm Masshoff, Mulheim/Ruhr; Udo Fritz Walter Praeckel, Kirchheimbolanden, both of Germany

[73] Assignee: Diversey Lever, Inc., Plymouth, Mich.

[21] Appl. No.: 646,363

[22] PCT Filed: Nov. 16, 1994

[86] PCT No.: PCT/EP94/03805

§ 371 Date: Aug. 26, 1996

§ 102(e) Date: Aug. 26, 1996

[87] PCT Pub. No.: WO95/14424

PCT Pub. Date: Jun. 1, 1995

[30] Foreign Application Priority Data

Nov. 20, 1993 [DE] Germany ..... 43 39 503.1
Sep. 30, 1994 [GB] United Kingdom ..... 9419702

[51] Int. Cl.[6] ..... B08B 9/20; B08B 3/00; B22D 7/06

[52] U.S. Cl. ..... 134/25.2; 134/47; 134/48; 134/52; 134/72; 252/174.24; 252/174.21

[58] Field of Search ..... 134/47, 48, 52, 134/72, 25.2, 25 R; 252/174.24, 174.21

[56] References Cited

U.S. PATENT DOCUMENTS 3,850,832 11/1974 Wegemund et al. ..... 252/99
4,891,148 1/1990 Ouhadi et al. ..... 252/99

FOREIGN PATENT DOCUMENTS 0 282 214 9/1988 European Pat. Off. .

*Primary Examiner*—Lynette F. Smith
*Attorney, Agent, or Firm*—A. Kate Huffman

[57] ABSTRACT

A machine dishwashing process for cleaning soiled crockery is provided. The process comprises: (1) optionally prewashing the crockery in a prewash zone; (2) washing the crockery in a wash zone with washing liquor; (3) spraying the crockery from the wash zone with a spraying solution; and (4) rinsing the crockery in a clear washing zone. The washing liquor includes used spraying solution from step (3). The spraying solution has an alkali content of at least 0.8 % by weight. An additive which is substantially free of alkali is supplied to the washing liquor to give a concentration in the washing liquor in the presence of the used spraying solution of at least 0.004 % by weight of complexing agent(s) and/or sequestering agent(s).

32 Claims, 2 Drawing Sheets

Fig. 2A
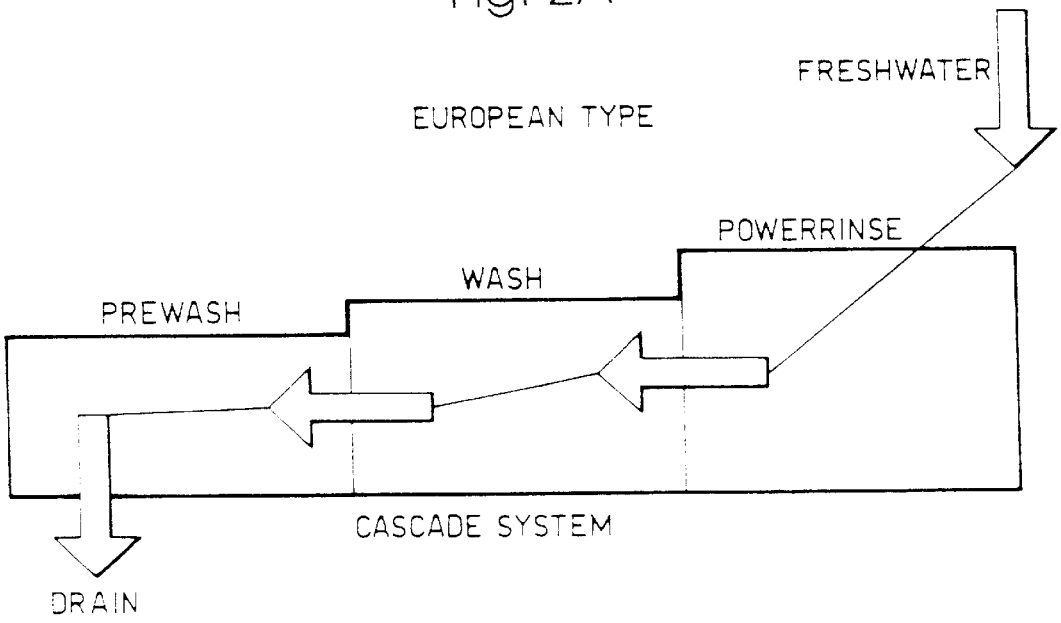
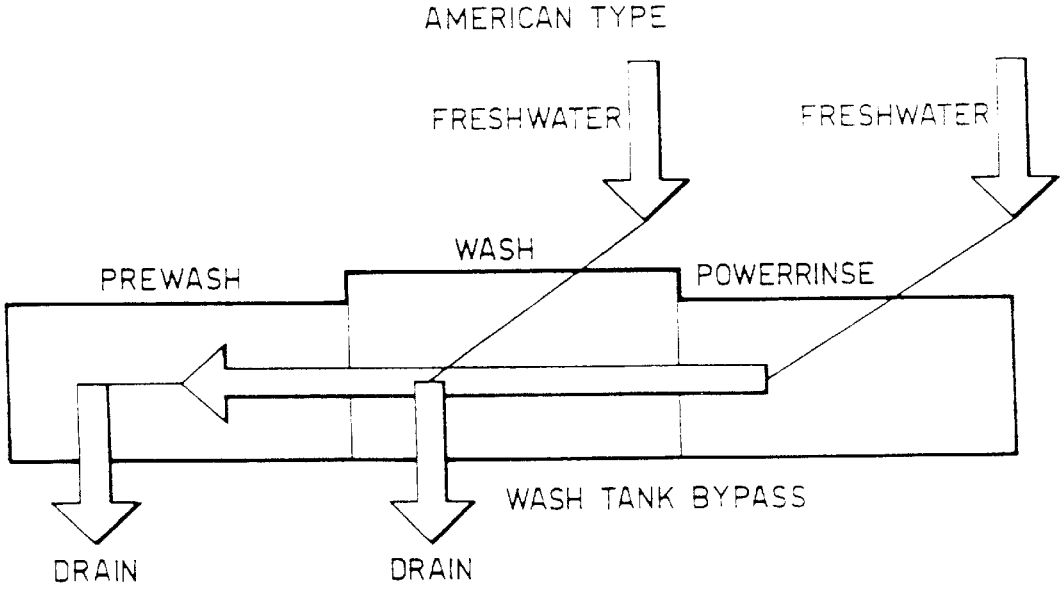
Fig. 2B

MACHINE DISHWASHING PROCESS

FIELD OF THE INVENTION

The invention relates to a machine dishwashing process for cleaning soiled crockery and to the use of a composition as an additive in such a process.

BACKGROUND TO THE INVENTION

In a typical machine dishwashing process, crockery, such as tableware or cookware, soiled with food or other matter is subjected to a number of treatments in a sequence of zones or cycles. In a main wash zone the soiled crockery is usually sprayed with washing liquor at a pressure sufficient to detach much of the soil present on the crockery. The wash zone may be preceded by a prewash zone in which the crockery is also sprayed with water or with overflow from the wash zone. After the wash zone the crockery is usually rinsed in one or more clear washing zones using fresh water.

Although a major factor in the effectiveness of the wash zone is the mechanical action of the washing liquor on the soiled crockery, in most cases the water pressure exerted is insufficient to detach completely adherent soil such as food residues which have dried on, are firmly adherent, or which contain colouring matter, especially when they contain protein and/or starch. It is also found that a deposit can build up on the crockery over the course of time during successive cleaning operations. In order to make the cleaning of the crockery more effective, it is therefore usual to add into the process a cleaning solution, which is usually supplied to the washing liquor as a concentrated liquid cleaner.

The cleaning solution generally contains alkali, such as sodium hydroxide or potassium hydroxide and is intended to remove the adherent soil by swelling or partially dissolving it to facilitate rinsing. The cleaning solution also contains complexing agents which are essential for sequestering metal ions present in hard water. Other additives may include bleach to decolourise food residues which contain colouring matter, surfactants to aid binding of dirt particles, and disinfecting components.

EP-A-0282214 discloses an improvement in machine dishwashing processes in which the crockery is washed in the normal way in the main wash zone and thereafter sprayed in a spraying step with a concentrated spraying solution before further rinsing. In the spraying step the crockery is subjected to a low volume/low intensity mist-like application of concentrated cleaning formulation and the crockery is allowed to remain in contact with the cleaning formulation for, say, at least ten seconds before rinsing. The concentrated cleaning formulation contains as essential ingredients both concentrated alkali and concentrated complexing agents.

A disadvantage of the arrangement of EP-A-0282214 is that the amounts of raw materials such as caustic and complexing agents are not easy to control. Typically, fresh water is applied in the rinse stage but concentrated cleaning solutions are supplied during the spraying step and in the main wash zone. In one typical arrangement, the water and other materials in the process pass in cascade-fashion in the rinse zone to prewash zone direction, counter-current to the direction of the transport of the crockery. Because concentrated raw materials are supplied to various stages of the wash cycle it is very difficult, therefore, to measure and control simply and accurately the amount of raw materials needed to be effective in cleaning the crockery. As a result, to ensure effective cleaning there is a tendency to put in more raw material than would actually be necessary. This adds to the running costs of the process and increases the amount of pollution when the waste water is discharged into the environment. Moreover, because a variety of different water hardness conditions are encountered at the site of use of the dishwashing process, it has hitherto been necessary to offer to users a range of products. The user then has had to select the product with the best combination of water hardness and causticity.

SUMMARY OF THE INVENTION

The present invention provides a machine dishwashing process for cleaning soiled crockery, which comprises:

(1) optionally prewashing the crockery in a prewash zone;

(2) washing the crockery in a wash zone with washing liquor;

(3) spraying the crockery from the wash zone with a spraying solution; and (4) rinsing the crockery in a clear washing zone; wherein the washing liquor includes used spraying solution from step (3), the spraying solution has an alkali content of at least 0.8% by weight, and an additive which is substantially free of alkali is supplied to the washing liquor to give a concentration in the washing liquor in the presence of the used spraying solution of at least 0.004% by weight of complexing agent(s) and/or sequestering agent(s).

In accordance with this process most or all of the alkali is supplied as spraying solution in the step of spraying the crockery. Contrary to previous practice it has been found unnecessary to add additional alkali to the washing liquor. Instead, spraying solution used in the spraying step is effectively recycled to the washing liquor for the purpose of washing crockery in the main wash zone. This recycling is typically achieved using a wash tank or reservoir in known fashion from which washing liquor may be pumped onto the crockery.

Because the additive supplied to the washing liquor is substantially free of alkali, the concentration of alkali in the washing liquor would be less than 0.001% by weight if no used spraying solution were present in the washing liquor, preferably less than 0.0004% by weight.

In a preferred embodiment, the spraying solution is substantially free of complexing agents and sequestering agents. This separates the tasks of cleaning and of complex formation from one another and reduces the amount of alkalinity which is contained in the washing liquor, thereby reducing the cost of operating the process and the amount of pollution in the waste water. In an alternative embodiment, the additive is supplied to the washing liquor with the spraying solution, preferably in an amount sufficient to prevent scale formation. In this embodiment, the additive may be supplied to the washing liquor by dosing the spraying solution from a separate additive reservoir. In this way, the amounts of spraying solution and additive can be separately controlled. Additive may also be supplied directly to the washing liquor in the wash zone.

The high alkalinity of the cleaner used in the spraying zone ensures complete detachment of the soiling matter, especially starch, protein and the additive facilitates complete detachment of colouring matter-containing food residues on the crockery, which are then completely rinsed off in the actual washing zone. The additive is also present to prevent the formation of scale inside the dishwashing machine and/or the spraying system.

By separating the tasks of cleaning and of complex formation from one another, operation of the process can occur in a more controlled manner. In particular, it is possible to deal on an individual basis with problems of rinsing, scale formation and cleaning for different purposes by adjusting separately the amount of alkali and complexing and/or sequestering agents present in the process. The amount of alkali in the process may be supplied in accordance with the amount of water supplied for spraying. The amount of alkali in the process as a whole will depend only on the rate of supply of alkali from the spraying solution in the spraying step. This enables a higher degree of control of the process than has hitherto been achieved because the amount of alkali entering the process is regulated in direct response to the entering spraying water and substantially independent of the machine water consumption.

The higher the alkali content in the spraying solution, the more effective the cleaning of the soiled crockery. However, this has to be balanced with the rinsability of the sprayed crockery and the cost of the alkali. Generally, the spraying solution has an alkali content of no more than 1.5%. It is usual to supply the spraying solution as a concentrated liquid cleaner which is diluted with water at a convenient point prior to spraying. The concentrated liquid cleaner typically has an alkali content of at least 25% by weight and is diluted to a concentration in the range 4% to 7% by weight for use in the process, advantageously to a concentration of about 5% by weight. The concentrated liquid cleaner generally has an alkali content of no more than 50% by weight, normally in the range 30% to 50% by weight.

In the context of the present invention the term "alkali" encompasses alkalis typical in cleaning detergents and alkali builders such as silicates. Alkalis typical in cleaning detergents include sodium hydroxide, potassium hydroxide, sodium carbonate and potassium carbonate. Sodium hydroxide and/or potassium hydroxide are preferred alkalis for use in the spraying solution.

The washing liquor comprises used spraying solution from the step of spraying the crockery and the additive containing the complexing agent(s) and/or sequestering agent(s). For the avoidance of doubt, it should be noted that there may be more than one complexing agent present in the additive. Similarly, there may be more than one sequestering agent.

Typically, the amount of complexing agent(s) and/or sequestering agent(s) in the washing liquor is sufficient to prevent scale formation in the dishwashing machine and preferably does not exceed 0.05% by weight in the presence of the used spraying solution. Typically, the additive is supplied to the washing liquor in concentrated form to give a dilution in the range 0.02% to 2% by weight, preferably in the range 0.02% to 0.08% by weight. For example, where the washing liquor is present in a wash tank or reservoir, the additive may be supplied to the tank or reservoir in proportion to the water consumption of the dishwashing machine. Preferably, the additive is supplied to the washing liquor at a dilution in the range 0.03% to 0.05% by weight and may advantageously contain at least 50% by weight of the complexing agent(s) and/or sequestering agent(s). The above additive quantities apply particularly to relatively soft water conditions. Where hard water is used, the quantities may need to be increased accordingly.

The complexing agent(s) and/or sequestering agent(s) may comprise a chelator capable of sequestering metal ions and removing them from activity in solution by forming an inactive complex. Typical chelators include ethylenediamine tetra acetic acid (EDTA), nitrilotriacetic acid (NTA), tripolyphosphates, and their sodium and potassium salts.

The additive may additionally or alternatively comprise a component to inhibit calcium deposition, such as an acrylic or methacrylic polymer and/or phosphonic acids and/or their sodium and/or potassium salts. Both of these polymers and phosphonates act to limit the formation of crystalline growth of calcium, thereby inhibiting its deposition. This can be useful in preventing build up of limescale within the machinery. Typically, acrylic/methacrylic polymers are present in the additive at concentrations of up to 5% by weight. Typically, phosphonic acids and/or phosphonates are also present in the additive at concentrations of up to 5% by weight.

As a further possibility, the additive may comprise a phosphate/polyphosphate or a citrate. Whichever component (s) is selected in the formulation of the additive, the alkali salt, neutral or acid form of the component may be used.

Each of the compositions supplied to the dishwashing machine may be in the form of a liquid, slurry, powder or solid and the dosing system must be constructed accordingly to bring each composition into solution and into the washtank/spraying system. Preferably, each composition will be formulated to have the highest possible amount of active ingredient in it while still maintaining the most preferred physical form. The use of fillers and other inessential ingredients is preferably avoided so as to prevent any negative environmental impact.

For example, the additive may be supplied as a powder having a composition in the following range: 80 to 90% by weight NTA and/or EDTA and/or tripolyphosphates and/or their potassium or sodium salt; 4 to 9% by weight phosphonic acid and/or its sodium or potassium salt; and 4 to 9% by weight acrylic or methacrylic polymer.

In the spraying step, cleaning solution is preferably applied to the crockery as a fine spray. A fine, gentle mist-like spray is particularly desirable. It is important that substantially the whole of the soiled surface of the crockery is contacted by the sprayed cleaning solution. A contact time of at least three seconds, preferably at least 8 seconds, is generally required for the sprayed cleaning solution to have the desired chemical effect. The concentrated spraying solution must contact the soiled crockery for a time sufficient to allow the soil to swell to enable it to be mechanically removed in the rinsing step. Generally a contact time of no more than 100 seconds is required, preferably ten to twelve seconds. Where the machine dishwasher is of the conveyor type, the speed of the conveyor belt may be chosen to given an appropriate contact time before the crockery enters the rinse section. As a further feature, the application of the cleaner solution may depend, for example, on a light barrier influenced by crockery present on the conveyor belt.

The present invention further relates to the use of a composition comprising at least 50% by weight of a complexing agent and/or sequestering agent and less than 5% by weight of alkali as an additive in a machine dishwashing process. The composition may be used as described herein to supply concentrated additive to the washing liquor and advantageously contains no more than 5% by weight of alkali, preferably less than 2% by weight.

BRIEF DESCRIPTION OF THE DRAWINGS

The invention will now be described in further detail by way of example only and with reference to the accompanying drawings, in which:

FIG. 2A is a schematic diagram of a European warewashing apparatus.

FIG. 2B is a schematic diagram of an American type warewashing apparatus.

DESCRIPTION OF THE PREFERRED EMBODIMENTS

Figure 1:
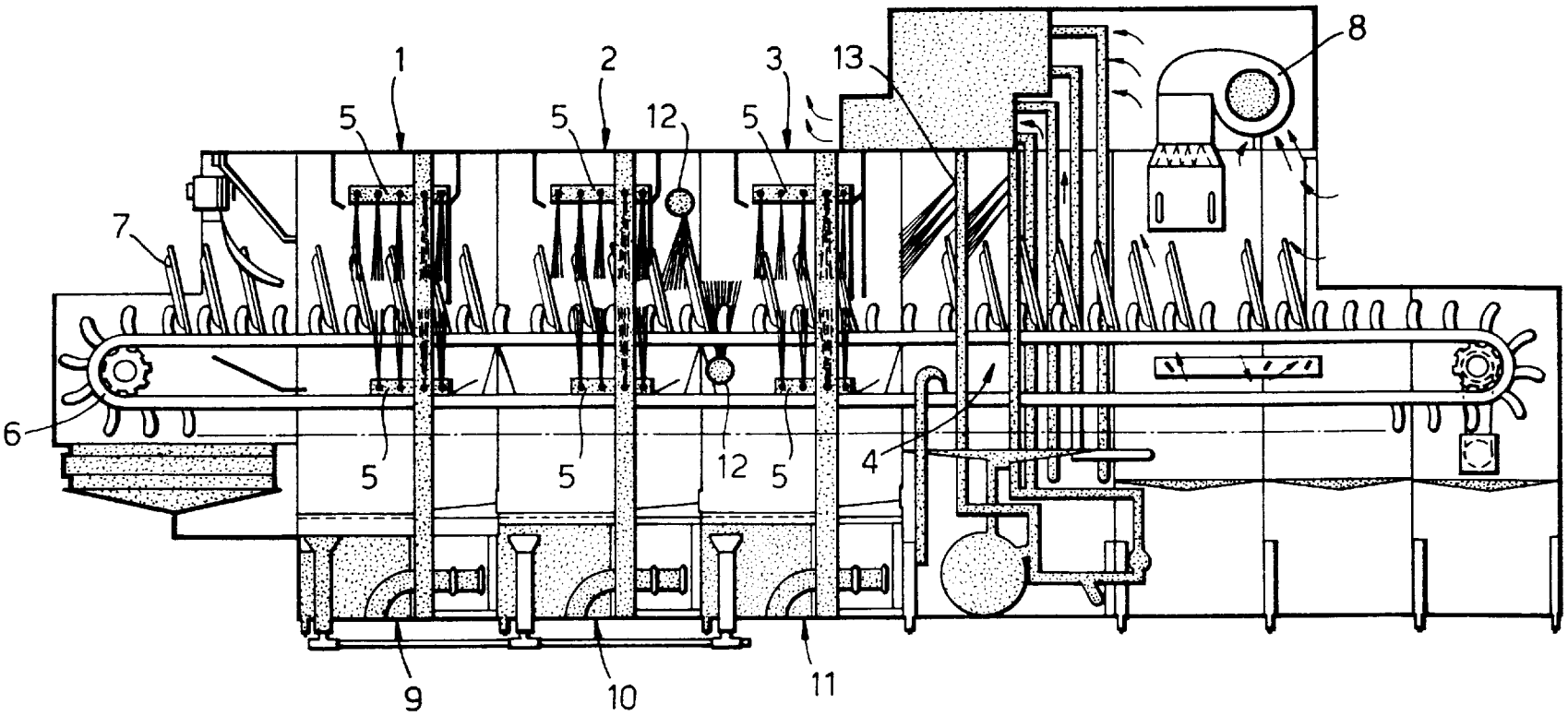
FIG. 1 shows a schematic diagram of a typical conveyor machine dishwasher which is usable in the present invention.

FIG. 1 shows a machine dishwasher of the conveyor type which operates by a cascade system. The dishwasher includes prewash zone 1, main wash zone 2, power rinse zone 3 and rinse section 4. Conveyor 6 is used to transport crockery 7 through each of the zones and conventional spraying units 5 are provided to spray the crockery. The crockery is dried with drying unit 8. Prewash tank 9, main wash tank 10 and power rinse tank 11 are provided to supply to their respective spraying units solutions appropriate to each zone.

In operation, soiled crockery is placed on the conveyor belt and is flooded in the prewash zone 1 with overflow water from the washing zone which is pumped to the spraying unit from prewash tank 9 and may have a temperature of about 40° C. Coarse food residues are thereby rinsed off the crockery. The prewashed crockery enters main wash zone 2 and is sprayed from the spraying unit with washing liquor from main wash tank 10. The washing liquor will include used spraying solution from sprays 12. Additive to the washing liquor is supplied to the main wash tank from a reservoir (not shown). Readily removable soil on the crockery is removed in the main wash zone by a combination of the mechanical action of the spraying and the chemical action of the recycled spraying solution.

The washed crockery now passes under the sprays 12 to remove any difficult remaining soil. Sprays 12 impart a fine mist-like spray of the concentrated spraying solution to the crockery and the speed of the conveyor is adjusted so that the sprayed crockery is not rinsed for at least ten seconds. This enables the concentrated spraying solution to cause the remaining soil to swell and possibly dissolve under the chemical action of the spraying solution. The remaining swollen residues are removed in the power rinse zone 3 by spraying with used rinse water at a temperature of about 65° C. from the power rinse tank. The rinse water originates from the final rinse section 4. After the power rinse, fresh water is supplied in spray jets 13 in final rinse section 4 at a temperature of about 85° C. The crockery is then subjected to drying under drying unit 8.

In accordance with this process, concentrated spraying solution was supplied to sprays 12 at a concentration of 3% by weight and had an alkali content of 30%. No complexing agents and/or sequestering agents were present in the concentrated spraying solution.

Additive was supplied to the washing liquor at a concentration of 0.05% by weight containing 30% by weight EDTA, 30% NTA by weight, 3% by weight acrylic/methacrylic polymers, 2% by weight phosphonates, the balance being water. No free alkali was present in the additive.

Crockery cleaned according to this process was found to be free of soil and free of alkalinity.

Referring to FIG. 2, the present invention is equally applicable to machine dishwashers operating by a washtank bypass system. According to this system, the prewash zone is supplied with water from the power rinse zone and not the wash zone. Fresh water is supplied to the wash zone and allowed to drain. The present invention may be applied to this system in essentially the same way as it is, applied to the cascade system described above. Sprays for spraying the concentrated spraying solution are situated so that crockery already washed in the wash zone is subsequently sprayed with the concentrated spraying solution.

What is claimed is:

1. A machine dishwashing process for cleaning soiled crockery, which comprises:

(1) washing the crockery in a wash zone with washing liquor;

(2) spraying the crockery from the wash zone with washing liquor;

(3) rinsing the crockery in a clear washing zone; wherein the washing liquor includes used spraying solution from step (2), the spraying solution has an alkali content of at least 0.8% by weight, and an additive which is substantially free of alkali is supplied to the washing liquor to give a concentration in the washing liquor in the presence of the used spraying solution of at least 0.004% by weight of complexing agent(s) and sequestering agent(s).

2. A process according to claim 1, wherein the spraying solution is substantially free of complexing agents and/or sequestering agents.

3. A process according to claim 1, wherein the spraying solution has an alkali content in the range 0.8% to 1.5% by weight.

4. A process according to claim 1, wherein the spraying solution is supplied as a concentrated liquid cleaner with an alkali content of at least 25% by weight and diluted in the range 4% to 7% by weight.

5. A process according to claim 1, wherein the concentration of alkali in the washing liquor is less than 0.0004% by weight in the absence of the used spraying solution.

6. A process according to claim 1, wherein the amount of complexing agent(s) and/or sequestering agent(s) in the washing liquor does not exceed 0.05% by weight in the absence of the used spraying solution.

7. A process according to claim 1, wherein the additive is supplied to the washing liquor at a dilution in the range 0.02% to 2% by weight.

8. A process according to claim 7, wherein the additive is supplied to the washing liquor at a dilution in the range 0.03% to 0.05% by weight.

9. A process according to claim 8, wherein the additive contains an amount of complexing agent(s) and/or sequestering agent(s) in the range 30% to 50% by weight.

10. A process according to claim 1, wherein the additive further comprises a component to,inhibit calcium deposition.

11. A process according to claim 1, wherein the additive is supplied to the washing liquor in step (2) with the spraying solution.

12. A machine dishwashing process for cleaning soiled crockery, which comprises:

(1) washing the crockery in a wash zone with washing liquor;

(2) Spraying the crockery from the wash zone with a spraying solution; and (3) rinsing the crockery in a clear washing zone; wherein the washing liquor includes used spraying solution from step (2) wherein the spraying solution has an alkali content of at least 0.8% by weight and is substantially free of complexing agents and sequestering agents, and wherein an additive which is substantially free of alkali is supplied to the washing liquor to give a concentration in the washing liquor in the presence of the used spraying solution of at least 0.004% by weight of complexing agent(s) and sequestering agent(s).

13. A process according to claim 12, wherein the spraying solution has an alkali content in the range 0.8% to 1.5% by weight.

14. A process according to claim 12, wherein the spraying solution is supplied as a concentrated liquid cleaner with an alkali content of at least 25% by weight and diluted in the range 4% to 7% by weight.

15. A process according to claim 12, wherein the concentration of alkali in the washing liquor is less than 0.0004% by weight in the absence of the used spraying solution.

16. A process according to claim 12, wherein the amount of complexing agent(s) and sequestering agent(s) in the washing liquor does not exceed 0.05% by weight in the absence of the used spraying solution.

17. A process according to claim 12, wherein the additive contains an amount of complexing agent(s) and/or sequestering agent(s) in the range of 30% to 50% by weight.

18. A process according to claim 12, wherein the additive is supplied to the washing liquor at a dilution in the range 0.02% to 2% by weight.

19. A process according to claim 18, wherein the additive is supplied to the washing liquor at a dilution in the range 0.03% to 0.05% by weight.

20. A process according to claim 19, wherein the additive contains an amount of complexing agent(s) and/or sequestering agent(s) in the range 30% to 50% by weight.

21. A process according to claim 12, wherein the additive further comprises a component to inhibit calcium deposition.

22. A process according to claim 12, wherein the additive is supplied to the washing liquor in step (2) with the spraying solution.

23. A machine dishwashing process for cleaning soiled crockery, which comprises:

(1) prewashing the crockery in a prewash zone;

(2) washing the crockery in a wash zone with washing liquor;

(3) spraying the crockery from the wash zone with a spraying solution; and (4) Rinsing the crockery in a clear washing zone; wherein the washing liquor includes used spraying solution from step (3), the spraying solution has an alkali content of at least 0.8% by weight, and an additive which comprises at least 50% by weight of a complexing agent and sequestering agent and less than 5% by weight of alkali is supplied to the washing liquor to give a concentration in the washing liquor in the presence of the used spraying solution of at least 0.004% by weight of complexing agent(s) and sequestering agent(s).

24. A process according to claim 23, wherein the additive comprises one or more complexing/sequestering agents selected from EDTA, NTA, phosphonic acids, citric acid, phosphoric acid and polymers thereof, sodium and potassium salts thereof, and acrylic/methacrylic polymers.

25. A process according to claim 23, wherein the additive comprises less than 2% by weight of alkali.

26. A process according to claim 23, wherein the additive is in the form of a solid, powder, slurry or liquid.

27. A process according to claim 21, wherein the additive comprises a powder comprising: 80 to 90% by weight NTA and/or EDTA and/or a tripolyphosphate, and/or the potassium or sodium salt thereof; 4 to 9% by weight phosphonic acid and/or its sodium or potassium salt; and 4 to 9% by weight acrylic or methacrylic polymer.

28. A machine dishwashing process for cleaning soiled crockery, which comprises:

(1) prewashing the crockery in a prewash zone;

(2) washing the crockery in a wash zone with washing liquor;

(3) spraying the crockery from the wash zone with a spraying solution; and (4) Rinsing the crockery in a clear washing zone; wherein the washing liquor includes used spraying solution from step (3), wherein the spraying solution has an alkali content of at least 0.8% by weight and is substantially free of complexing agents and sequestering agents, and wherein an additive which comprises at least 50% by weight of a complexing agent and sequestering agent and less than 5% by weight of alkali is supplied to the washing liquor to give a concentration in the washing liquor in the presence of the used spraying solution of at least 0.004% by weight of complexing agent(s) and sequestering agent(s).

29. A process according to claim 28, wherein the additive comprises one or more complexing/sequestering agents selected from EDTA, NTA, phosphonic acids, citric acid, phosphoric acid and polymers thereof, sodium and potassium salts thereof, and acrylic/methacrylic polymers.

30. A process according to claim 28, wherein the additive comprises less than 2% by weight of alkali.

31. A process according to claim 28, wherein the additive is in the form of a solid, powder, slurry or liquid.

32. A process according to claim 26, wherein the additive comprises a powder comprising: 80 to 90% by weight NTA and/or EDTA and/or a tripolyphosphate, and/or the potassium or sodium salt thereof; 4 to 9% by weight phosphonic acid and/or its sodium or potassium salt; and 4 to 9% by weight acrylic or methacrylic polymer.

* * * * *